United States Patent [19]

Buchner et al.

[11] Patent Number: 4,533,063

[45] Date of Patent: Aug. 6, 1985

[54] CONTAINER LID HAVING AN OPENING DEVICE

[75] Inventors: Norbert Buchner, Winnenden; Rolf Eberspächer, Rommelshausen; Dieter Liede, Möglingen, all of Fed. Rep. of Germany

[73] Assignee: Robert Bosch GmbH, Stuttgart, Fed. Rep. of Germany

[21] Appl. No.: 534,455

[22] Filed: Sep. 21, 1983

[30] Foreign Application Priority Data

Sep. 23, 1982 [DE] Fed. Rep. of Germany ..... 3235167

[51] Int. Cl.[3] ..... B65D 17/34

[52] U.S. Cl. ..... 220/270; 220/267; 220/260; 229/7 R

[58] Field of Search ..... 220/266, 267, 270, 260, 220/257, 258; 156/257; 413/8, 12, 14, 17; 229/7 R

[56] References Cited

U.S. PATENT DOCUMENTS

| | | | |
|---|---|---|---|
| 4,267,937 | 5/1981 | Piltz et al. | 220/270 |
| 4,403,710 | 9/1983 | Hirota et al. | 220/270 |
| 4,428,494 | 1/1984 | Hirota et al. | 220/270 |
| 4,448,324 | 5/1984 | Jeppson et al. | 220/266 |

*Primary Examiner*—George T. Hall

*Attorney, Agent, or Firm*—Edwin E. Greigg

[57] ABSTRACT

A lid for a packaging container which include a tear-open part which is surrounded by a weakened line. The lid is molded of a composite material, which has an outer carrier layer of plastic, a middle barrier layer of metal foil and an inner heat-sealing layer of a thermoplastic synthetic material. The weakened line is produced as an indentation in the outer carrier layer by being heat-impressed using a heated tool.

14 Claims, 6 Drawing Figures

CONTAINER LID HAVING AN OPENING DEVICE

BACKGROUND OF THE INVENTION

The invention is based on a container lid including an opening device. A lid of this kind, known by way of example from European Patent Application 000 4834, comprises a relatively thick carrier layer shaped from thermoplastic material in an injection molding process, the inside of which has combined with it a relatively thin aluminum/plastic laminate sheet, as a barrier layer. For the sake of easy opening of the lid, a weakening line is disposed surrounding a tear-open part; this weakening line penetrates the plastic layer completely in parts and is formed during the course of the injection molding process. A container lid of this kind is expensive because of the manner of its fabrication. First the carrier layer, as an outer part, is injection-molded in a mold, which is very slow and expensive. Then a sheet of aluminum/plastic laminate is sealed to the carrier layer. To the carrier layer and the laminate sheet must be delivered to the work station and positioned individually. The known lid also has the disadvantage that when the laminate sheet is applied to the angled sealing flange of the lid, wrinkles are formed, which can prevent a container from being tightly sealed by such a lid.

A container lid is also known from German Auslegeschrift DE-AS No. 20 23 923, having a tear-open part surrounded by indented lines, which is molded of a metal/plastic laminate. This lid has a relatively thick carrier and barrier layer comprising a metal plate, to the inside of which a relatively thin plastic film is glued and which acts as a corrosion and protective layer. The indented lines surrounding the tear-open part in this lid are impressed into the thick metal plate. Although the known lid is rigid and tight, it is very expensive because of the high proportion of metal it contains.

It is accordingly an object of the invention to create an easily openable container lid which is rigid, strong and tight and which can be formed in a simple manner from a strip of laminate.

The container lid according to the invention has the advantage that it can be formed in a non-wrinkling manner, in great quantity, by deep drawing a strip of plastic/metal laminate available in commerce, and its weakening line can be produced in a simple manner. Depending upon the configuration of the lid, the weakening lines can be impressed into the plastic carrier layer rapidly and in a positionally accurate manner with a heated indenting tool either before or after the forming.

As a result, advantageous further developments of the container lid disclosed are possible. A particularly advantageous feature is the disposition of ridges at either side of the weakening line. A thickening of the material in this manner provides good guidance as the tear-open part is being torn out, and it prevents the tear line from going off course. It is also possible to secure a pull tab directly to the outer carrier layer without great expense by heat-sealing means, the tab either comprising or being coated with a heat-sealable plastic.

The container lid according to the invention can be produced in great quantity and in a simple manner.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
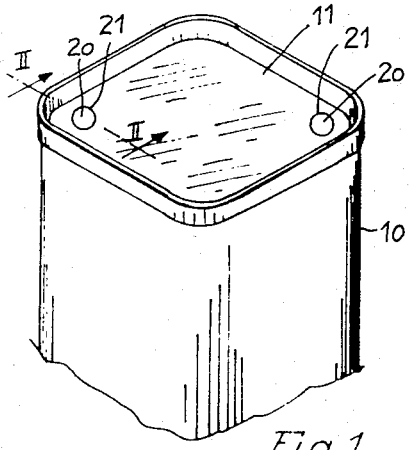
FIG. 1 shows the upper portion of a container having a lid, seen in a perspective view.

A packaging container having a body 10 of a multi-layered packaging material is closed at its upper opening with a lid 11, which has an easily manipulated opening device for the sake of removing the contents. The basic outline of the body 10 and lid 11 is in the shape of a square with rounded corners. The lid 11 has a U-shaped rim fold 12, which grips the opening rim of the body 10 and is sealed or welded thereto. The rim fold 12 is formed by deep drawing or cupping.

For producing the lid 11, a multi-layered composite material is used, which has an outer layer 14 of plastic, a middle layer 15 of metal (preferably aluminum) and an inner layer 16 of a heat-sealable plastic. The individual layers may be combined with one another by means of a laminating adhesive. The outer layer 14, which as the carrier layer lends the lid its rigidity and strength, is approximately 100 to 400 m thick, preferably 200 m thick, and comprises a thermoplastic synthetic material such as polyvinyl chloride (PVC), polyester (PETP), polystyrene (PS), polycarbonate (PC) or the like. The middle layer 15, which contributes barrier properties to the lid, comprises an aluminum or steel foil having a thickness of from 20 to 40 m. The inner layer 16, which serves the purpose of heat-sealing or welding to the body 10 and acts as an insulating layer, has a thickness of approximately 50 m and comprises polyethylene (PE), polypropylene (PP), polyvinylidene chloride (PVDC), polyester (PETP) or else a heat-sealing lacquer.

Figure 4:
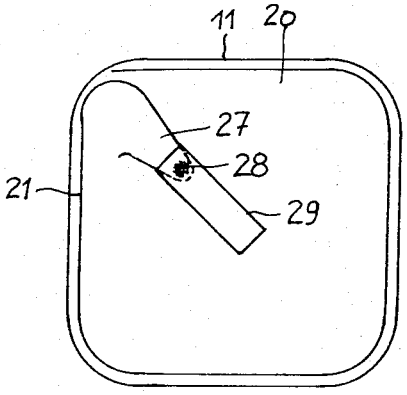
Figure 5:
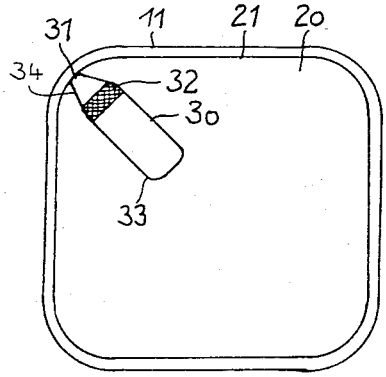

The opening device in the lid 11 has a removable tear-open part 20, which is surrounded by a weakened line 21. The tear-open part 20 may take various forms, such as a circular area (FIG. 1) for the insertion of a drinking straw, teardrop shape (FIG. 2), or a tear-open area adapted to the plane surface of the lid and intended for effecting the complete removal of the lid (FIGS. 4 and 5).

Figure 6:
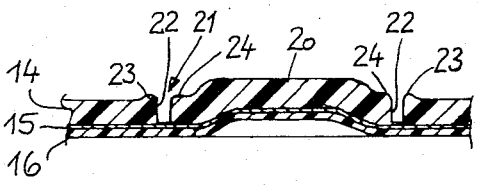
FIG. 6 shows a portion of a container lid on an enlarged scale and in cross section.

The weakened line 21 is disposed solely in the outer carrier layer 14 and either completely or nearly completely penetrates the thickness thereof in the form of an indentation 22. The indentation 22 is heat-impressed into the carrier layer 14 by means of a heated indenting tool, in the course of which plastic is melted and positively displaced under the influence of both pressure and heat. The result is the formation, at either side of the indentation 22 of the weakened line 21, of ridges 23, 24 (FIGS. 2 and 6) protruding above the plane of the top of the carrier layer 14. The thickening of the carrier layer 14 beside the indentation 22 produced by means of the ridges 23, 24 helps to assure that when the tear-open part 20 is torn out or broken open, the tear will extend along the weakened line 21 and not depart from it.

Figure 2:
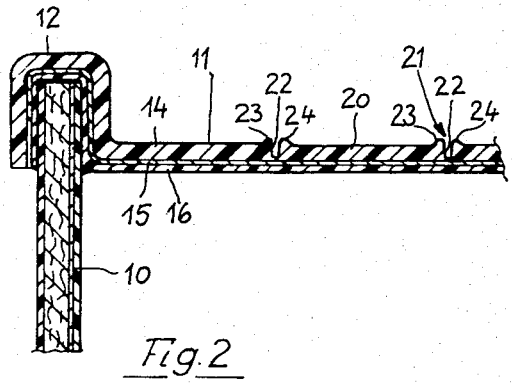
FIG. 2 shows a portion of the container and lid of FIG. 1 on a larger scale and in a cross section taken in the plane II—II of FIG. 1.

In the exemplary embodiment of FIGS. 1 and 2, there are two circular tear-open parts 20 one of which is provided in order to form a pour opening and the other of which is intended to provide ventilation. The diameter of the circular weakened line 21 is larger than that of a drinking straw, so that a drinking straw can be placed on the tear-open part 20 and the part 20 can be broken out of the surface of the lip by the application of pressure; the middle metal layer 15 and the inner plastic layer 16 then offer only so much resistance as can be easily overcome. In order to stiffen the tear-open part 20, it may be embodied with a convex curvature, as shown in the exemplary embodiment of FIG. 6.

Figure 3:
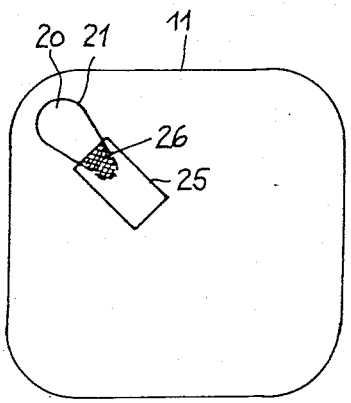
FIGS. 3–5 are plan views of container lids having various embodiments of the opening device.

In the exemplary embodiment of FIG. 3, the tear-open part 20 has a teardrop shape. For tearing out the tear-open part 20, a heat-sealable gripping tab 25, made from a sheet of plastic, is welded to the plastic layer 14 at the narrow end of the tear-open part 20 by means of a welding area 26.

In the lid 11 of FIG. 4, for the sake of effecting the complete removal of the plane surface of the lid, the weakened line 21 extends parallel to and close to the rim fold 12 and additionally forms a teardrop-shaped starting section 27, with which a gripping tab 29 is connected by means of a welding point 28.

The exemplary embodiment of FIG. 5 has a stiff double lever 30 in the starting area, acting as a gripping tab; the double lever 30 has a breakage edge 31 coinciding with a portion of the weakened line 21. The double lever 30 is connected with the outer plastic layer 14 by means of a welding line 32, which represents the axis for the double lever 30. As the longer, free arm 33, which is located opposite the shorter arm 34 having the breakage edge 31, is pulled upward, the weaking line 21 begins to be torn inward in the vicinity of the breakage edge 31. As the double lever 30 is pulled further, the entire tear-open part 20 is then torn out of the lid 11.

The foregoing describes several exemples of possible embodiments for the tear-open part which is surrounded by the heat-indented weakened line. However, other forms of embodiment are also possible within the scope of the invention, among them those in which the weakening line is not a closed shape, so that the tear-open part will remain partly connected to the rest of the lid for environmental reasons. Furthermore, a composite material having three layers has been described for the production of a lid according to the invention. Nevertheless, the use of composite materials having some other structure is also possible within the scope of the invention, so long as the carrier layer comprises a thermoplastic synthetic material and the melting temperature of the layer adjacent to it is higher than that of the carrier layer.

The weakened lines can be produced either before the lid is formed, being heat-impressed into the strip material used for producing the lid, or afterward, being heat-impressed into lids which are already formed.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A container lid having an opening device, said lid comprising at least an outer, thick carrier layer made of a thermoplastic synthetic material and an inner sealing layer capable of being welded to a container body, said carrier layer including a weakened line indentation at least partially surrounding a tear-open portion, characterized in that the container lid is formed by a composite laminate material and that the weakened indentation line in the carrier layer of the composite material is embodied as a heat-impressed indentation.

2. A container lid as defined by claim 1, characterized in that the indentation completely penetrates the carrier layer.

3. A container lid as defined by claim 1, characterized in that the indentation almost completely penetrates the carrier layer.

4. A container lid as defined by claim 1, characterized in that said lid includes ridges which are disposed on the carrier layer at either side of the indentation, which ridges protrude above the plane of the top of the lid.

5. A container lid as defined by claim 2, characterized in that said lid includes ridges which are disposed on the carrier layer at either side of the indentation, which ridges protrude above the plane of the top of the lid.

6. A container lid as defined by claim 3, characterized in that said lid includes ridges which are disposed on the carrier layer at either side of the indentation, which ridges protrude above the plane of the top of the lid.

7. A container lid as defined by claim 1, characterized in that a gripping tab is sealed on the tear-open part surrounded by the indentation.

8. A container lid as defined by claim 2, characterized in that a gripping tab is sealed on the tear-open part surrounded by the indentation.

9. A container lid as defined by claim 3, characterized in that a gripping tab is sealed on the tear-open part surrounded by the indentation.

10. A container lid as defined by claim 4, characterized in that a gripping tab is sealed on the tear-open part surrounded by the indentation.

11. A container lid as defined by claim 7, characterized in that said lid includes ridges which are disposed on the carrier layer at either side of the indentation, which ridges protrude above the plane of the top of the lid.

12. A container lid as claimed in claim 1 in which said composite laminate material includes three layers.

13. A method for producing a container lid which comprises: welding an inner sealing layer to an outer, thick carrier layer of a thermoplastic synthetic material with said inner sealing layer being capable of being welded to a container body, forming an indentation in the form of a weakened line in the carrier layer in which said weakened line partially surrounds a tear-open part wherein said indentation is formed by a heated tool.

14. A method for producing a container lid which comprises: bonding an inner sealing layer to an outer, thick carrier layer of a thermoplastic synthetic material or a layer between these layers with said inner sealing layer being capable of being heatsealed to a container body, forming an indentation in the form of a weakened line in the carrier layer in which said weakened line at least partially surrounds a tear-open part wherein said indentation is formed by a heated tool.

* * * * *